US012612780B2

(12) United States Patent
Kim et al.

(10) Patent No.: US 12,612,780 B2
(45) **Date of Patent: *Apr. 28, 2026**

(54) SYSTEMS AND METHODS FOR A MODULAR BUILDING

(71) Applicant: Welkin Modular, Inc., San Diego, CA (US)

(72) Inventors: Brian Kim, Chula Vista, CA (US); William Kim, Chula Vista, CA (US)

(73) Assignee: Welkin Modular, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/642,786

(22) Filed: Apr. 22, 2024

(65) Prior Publication Data

US 2024/0392557 A1 Nov. 28, 2024

Related U.S. Application Data

(63) Continuation of application No. 17/226,022, filed on Apr. 8, 2021, now Pat. No. 11,965,328.

(60) Provisional application No. 63/007,139, filed on Apr. 8, 2020.

(51) Int. Cl.

| | |
|---|---|
| ***E04B 1/348*** | (2006.01) |
| ***E04H 1/00*** | (2006.01) |
| ***E04H 1/12*** | (2006.01) |

(52) U.S. Cl.

CPC ..... *E04B 1/3483* (2013.01); *E04H 1/005* (2013.01); *E04H 1/12* (2013.01); *E04H 2001/1283* (2013.01)

(58) Field of Classification Search

CPC ..... E04B 1/3483; E04B 2001/1921; E04B 2001/1975; E04B 2001/1963; E04H 1/12; E04H 1/005; E04H 2001/1283

See application file for complete search history.

(56) References Cited

U.S. PATENT DOCUMENTS 3,218,097 A * 11/1965 Bowers ..... F16B 7/025 403/295
3,500,595 A * 3/1970 Bennett ..... E04B 1/3483 D25/123
3,532,369 A * 10/1970 Reilly ..... E04G 7/22 403/178
3,645,569 A * 2/1972 Reilly ..... F16B 7/0446 403/217
3,666,298 A * 5/1972 Reilly ..... F16B 12/40 403/172
3,858,989 A * 1/1975 Field ..... A47B 47/0008 403/171
4,299,065 A * 11/1981 Fairgrieve ..... E04B 1/3483 52/79.11
4,558,968 A * 12/1985 Meickl ..... E04B 1/2604 403/255

(Continued)

*Primary Examiner* — Gisele D Ford

(74) *Attorney, Agent, or Firm* — Kumar Maheshwari; Mahesh Law Group PC

(57) ABSTRACT

Systems and methods for a modular building are disclosed. A modular building system includes a multitude of rods that are configured to connect to each other to form a frame where one or more u-shaped channel pieces are attached to at least one of the multitude of rods. The modular building system includes panels that are shaped to be inserted within the u-shaped channel pieces to form a side.

13 Claims, 14 Drawing Sheets

(56) References Cited

U.S. PATENT DOCUMENTS 4,781,001 A * 11/1988 Ryan ..... H02G 3/283 52/334
4,910,932 A * 3/1990 Honigman ..... E04B 1/08 52/282.4
5,230,197 A * 7/1993 Hart ..... E04B 1/19 52/638
5,706,614 A * 1/1998 Wiley, Jr. ..... E04B 1/3483 52/537
5,839,248 A * 11/1998 Liang ..... A47B 47/005 403/171
5,997,117 A * 12/1999 Krietzman ..... H02B 1/301 403/219
6,832,580 B2 * 12/2004 Marchioro ..... A01K 1/03 D30/114
7,883,288 B2 * 2/2011 Jorna ..... F16B 7/0453 403/171
8,397,441 B2 * 3/2013 Wallance ..... E04B 1/348 52/79.1
9,598,852 B2 * 3/2017 O'Neal ..... E04B 1/34315
9,932,734 B1 * 4/2018 Winter ..... E04B 1/1903
10,583,975 B2 * 3/2020 Flynn ..... B65D 81/055
10,920,413 B2 * 2/2021 Nicholas ..... E04B 1/0046
D927,965 S * 8/2021 Bowron ..... D8/382
11,479,961 B2 * 10/2022 Bowron ..... E04B 1/1903
11,536,020 B2 * 12/2022 Bowron ..... E04H 1/005
11,732,459 B2 * 8/2023 Bowron ..... E04B 1/34331 52/655.1
12,234,935 B1 * 2/2025 Strasser ..... F16L 37/02
2005/0084324 A1 * 4/2005 Dubensky ..... E04B 1/3483 403/305
2006/0053702 A1 * 3/2006 Kelly ..... E04D 13/1643 52/90.1
2008/0289292 A1 * 11/2008 Giles ..... E04B 5/02 52/745.19
2009/0087255 A1 * 4/2009 Jorna ..... F16B 7/0453 403/171
2009/0313938 A1 * 12/2009 Li ..... E04B 1/19 52/656.9
2010/0031599 A1 * 2/2010 Kennedy ..... E04B 5/02 428/137
2011/0162293 A1 * 7/2011 Levy ..... E04B 1/3483 52/79.9
2013/0306808 A1 * 11/2013 Huang ..... A47B 13/06 248/163.1
2015/0121774 A1 * 5/2015 Pienimaa ..... E04B 1/34384 52/79.1
2016/0138258 A1 * 5/2016 Schaffert ..... E04B 1/3445 52/79.5
2017/0362811 A1 * 12/2017 King, Jr. ..... F16B 12/40
2019/0330837 A1 * 10/2019 Nicholas ..... E04F 10/08
2021/0277649 A1 * 9/2021 Bowron ..... E04B 1/2403

* cited by examiner

SYSTEMS AND METHODS FOR A MODULAR BUILDING

CROSS REFERENCE TO PRIOR APPLICATIONS

This application is a continuation of U.S. patent application Ser. No. 17/226,022, entitled "Modular Stackable Housing System", filed Apr. 8, 2021, which claims the benefit of U.S. Provisional Patent Application No. 63/007,139, entitled as "Modular Stackable Housing System", filed Apr. 8, 2020, all of which are incorporated by reference in their entirety.

FIELD OF THE INVENTION

This disclosure relates generally to the field of housing. More specifically, this disclosure relates to a modular stackable housing system.

BACKGROUND

The term modular, when applied to buildings often refers to the practice of producing sections of a building separately to be connected only after the sections are substantially complete. Modular building sections are usually started in a manufacturing facility rather than on site. Thus, various aspects of manufacture are cheaper and more efficient. On the other hand, transportation of a modular building is challenging. Further, assembling a modular building on site can require special equipment and know-how. Modifying a modular building per a client request can also be challenging. And because the cost of modular buildings is still comparable to conventionally built buildings, most buildings built are not modular. There is a continual need for innovations in methods and systems for modular buildings that advance its technology to make it more mainstream.

SUMMARY

A general aspect of the current invention includes a modular building system. The modular building system includes a multitude of rods that are configured to connect to each other to form a frame where u-shaped channel pieces are attached to at least one of the multitude of rods. The modular building system includes panels that are shaped to be inserted within the one or more u-shaped channel pieces to form a side. The frame may form a first box frame that includes twelve edges where the twelve edges of the first box frame enclose six separate sides. The modular building system may further include a second box frame comprising twelve edges and six sides where at least one edge of the second box frame is configured to be connected to the first box frame. Additional box frames may be connected to the first box frame and the second box frame to form a habitable structure. The habitable structure may include one or more floors, one or more windows, one or more walls, and one or more ceilings. At least one of the panels may include a corrugated metal. The modular building system may further include insulation that is inserted into folded portions of the corrugated metal. The modular building system may further include corner castings where the multitude of rods connect to each other via the corner castings.

An exemplary embodiment is a method for constructing a modular building. The method includes connecting a multitude of rods to form a frame where one or more u-shaped channel pieces are attached to at least one of the multitude of rods. The method includes inserting panels within the u-shaped channel pieces to form a side of the frame. The method may further include forming the frame into a first box frame. The method may further include connecting a second box frame to the first box frame. The method may further include connecting additional box frames onto the first box frame and second box frame to form a habitable structure. The habitable structure may include one or more floors, one or more windows, one or more walls, and one or more ceilings. At least one of the panels may include a corrugated metal. The method may include inserting insulation into folded portions of the corrugated metal. The multitude of rods may connect to each other via corner castings.

Another general aspect is a modular building system. The modular building system includes a multitude of corner castings, rods that connect to corner castings, u-shaped channel pieces that are attached to the rods, and panels that are shaped to be inserted within the u-shaped channel pieces to form a side. The connections between the rods and corner castings form a first box frame. At least one edge of the second box frame may be configured to be connected to the first box frame. At least one of the panels may include a corrugated metal. The modular building system may further include insulation that is inserted into folded portions of the corrugated metal. The modular building system may further include one or more components selected from a list consisting of plumbing and electrical wire where the one or more components are inserted into folded portions of the corrugated metal and the insulation covers the one or more components.

DETAILED DESCRIPTION

Figure 1:
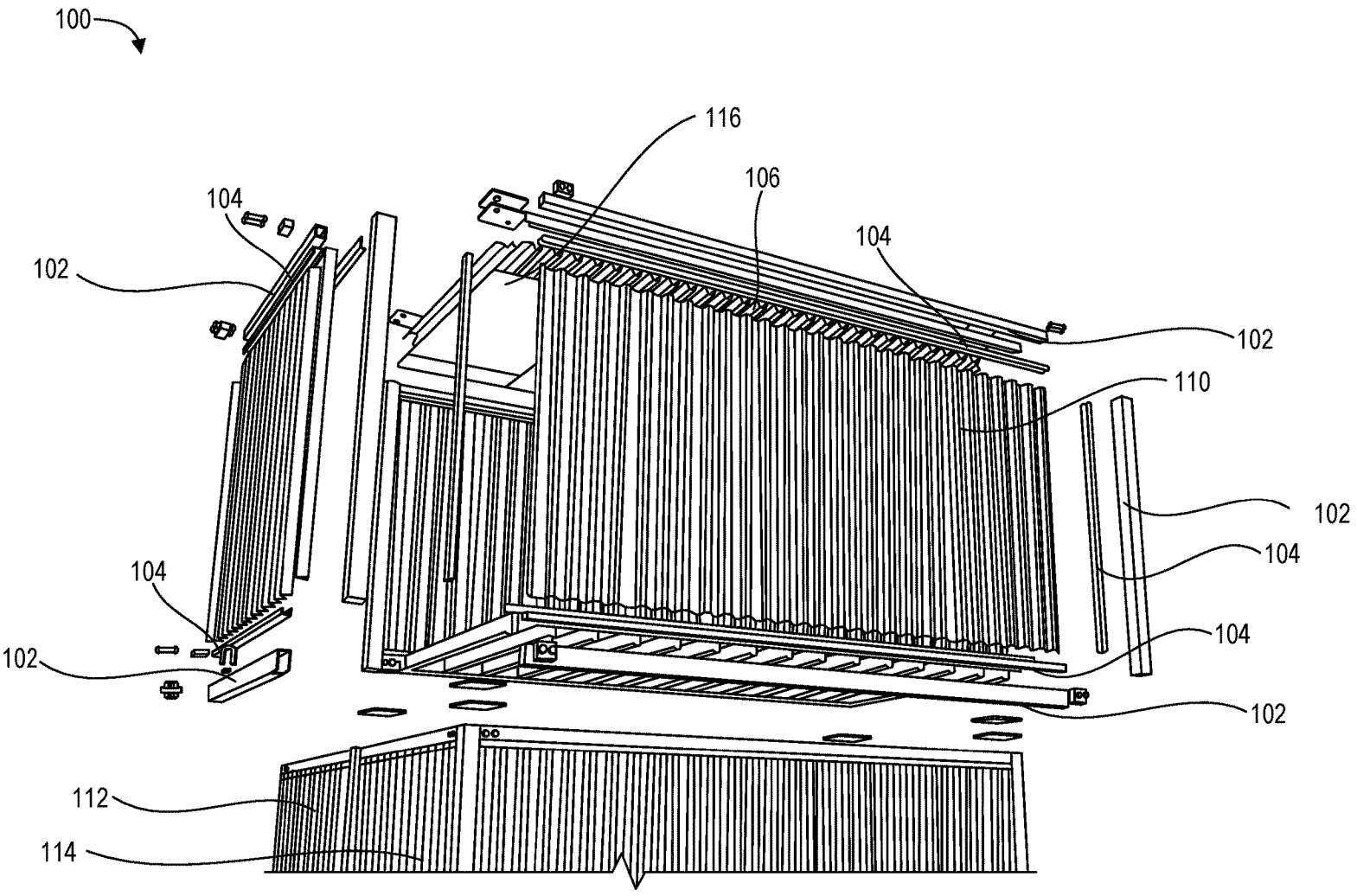
FIG. 1 is an illustration of an embodiment of the disclosed subject matter.

The disclosed subject matter is a method and system for building a modular structure. The modular structure may comprise a variety of buildings such as a residential building, office building, commercial building, industrial building, and the like. The modular building comprises a multitude of rectangular box frames that are coupled to one another. The rectangular box frames may be assembled from a multitude of rods. U-shaped channel pieces may be attached to one or more of the multitude of rods in the rectangular box frame.

Building materials, such as panels may be inserted into the open portions of the u-shaped channel pieces to couple the building materials to the u-shaped channel pieces. In an exemplary embodiment, building materials may be inserted into the u-shaped channel pieces by sliding the building materials within the open portion of the u-shaped channel pieces.

Additional rectangular box frames may be coupled to the original rectangular box frame. Accordingly, a multitude of rectangular box frames may be coupled to one another. The coupled multitude of rectangular box frames may be used as a frame for a habitable structure such as a house or an office. In various embodiments, whole modules of the habitable structure are constructed off-site and delivered to a construction site. The delivered modules may be welded to one another and constructed into a habitable structure at the construction site. In other embodiments, prefabricated components of the modules are flat-packed. The flat packed modules are assembled into the rectangular box modules of the habitable structure on site.

In various embodiments, the disclosed subject matter may include one or more corner pieces. The corner pieces may comprise two or more prongs that are oriented along axes that are orthogonal to one another. The two or more prongs are connected at one end to form a corner of the rectangular box frame. The rods that connect to form the rectangular box frame may connect to an end of the prongs of the corner pieces. The rods may be connected through various means such as bolting or welding.

In an exemplary embodiment, the disclosed subject matter may include posts that are thicker than the rods. The rods may be coupled to the posts to make right angles with the posts. In one example, a rectangular box frame includes four posts oriented vertically and eight rods oriented horizontally. The posts and rods of the rectangular box frame may comprise the edges of the rectangular box frame. In various embodiments, additional rods may be coupled to the rectangular box frame along a side of the rectangular box frame. U-shaped channel pieces may be fixed to the rods. Two u-shaped channel pieces may create a groove to which panels may be inserted in create a side of the rectangular box frame. Building materials, such as panels, may be inserted into open portions of parallel u-shaped channel pieces that are coupled to a side of a rectangular box frame.

In various embodiments, one or more panels may form a side of the rectangular box frame. Alternatively, the one or more panels may form a portion of a side of the rectangular box frame. And alternatively, a side of the rectangular box frame may comprise two or more panels that each form a portion of the side. In an exemplary embodiment, the panel may comprise a corrugated metal. For example, the panel may comprise corrugated steel. The panel, made of corrugated steel, may be affixed to the rectangular box frame by sliding the corrugated steel within the open portions of parallel u-shaped channel pieces. The panel of corrugated steel may be inserted and affixed to one or more sides of the rectangular box frame. Additionally, the panels of corrugated steel may comprise a portion of one or more sides of the rectangular box frame.

To the one or more panels of corrugated steel that are affixed to the rectangular box frame, insulation may be inserted into folds of the corrugated steel. Thus, the panel, made of corrugated steel with insulation, may provide both insulation and rigidity to a structure made of a multitude of rectangular box frames. Additionally, the corrugated steel is relatively thin even with insulation inserted into the folds of the corrugated steel, which saves space in the overall structure. Additional construction elements that may be added to the corrugated metal include, but are not limited to electrical conduits, wiring, plumbing, exterior sheathing with waterproofing, exterior façade, and interior drywall.

The term "frame," as used herein, refers to a rigid structure that surrounds an enclosure. Examples may be a window frame or a door frame. The term "rectangular box frame" refers generally to a frame in the shape of a rectangular box. The rectangular box comprises six sides, each of which are rectangles. The rectangular box frame has twelve edges. Typically, each of the twelve edges in the rectangular box frame comprises one or more rods. The term "rectangular box" is not intended to limit this disclosure to a perfect rectangular box, but to describe the general shape of a building element of a structure for better understanding.

Accordingly, the rectangular box described herein is not intended to be limited to perfectly rectangular sides with perfect right angles and may not always have opposing sides that are parallel and of equal length. The "rectangular box" described herein may not always have six sides and twelve edges. In various embodiments, one or more of the rectangular boxes in a structure may omit one or more sides and edges.

The term "rectangular box frame" generally refers to a frame comprising twelve rods that make up the twelve edges of the rectangular box. The term "rectangular box" generally refers to the frame of a rectangular box with one or more panels covering the sides of the rectangular box. Accordingly, the term "rectangular box," as used herein, is a "rectangular box frame" that includes panels for one or more sides.

The term "habitable structure," as used herein, refers to a sheltered structure with a roof, walls, floors, and space for a human individual to live or work inside the structure. The habitable structure may comprise a home, a workspace, or similar buildings.

Referring to FIG. 1, FIG. 1 is an illustration 100 of an embodiment of the disclosed subject matter including three rectangular boxes. The rectangular box 110 on top is shown in an exploded view. The rectangular box 112 under rectangular box 110 is coupled to rectangular box 114. Edges of the rectangular box 112 comprise a multitude of rods 102. U-shaped channel pieces 104 are attached to many of the rods 102. The term "rod" used herein refers generally to elongated structural elements that include, but are not limited to I-beams, hollow rods, tubing, and the like. Two u-shaped channel pieces 104 may be positioned on parallel opposing rods 102 with open portions of the u-shaped channel pieces 104 facing toward one another.

Doing so allows parallel opposing u-shaped channel pieces 104 to become a large slot to receive panels 106, which would complete the wall once the panel 106 has been installed. The panel 106 may be fastened to the u-shaped channel pieces 104 by bolts, screws, rivets, similar fastening means, or attached permanently by welding or similar means. This process may be repeated to recreate similar or identical wall elements, or build a ceiling, roof, or floor elements to complete a structure.

The rectangular box 110 on top may be coupled to rectangular box 112. Rectangular box 110 comprises a multitude of rods 102 that are coupled to one another to form the frame for rectangular box 110. One or more of the rods 102 that form the rectangular box frame may be welded to u-shaped channel pieces 104. The rods 102 and u-shaped channel pieces 104 may comprise a variety of materials including, but not limited to steel, low carbon steel, stainless steel, brass, bronze, copper, titanium, and various metal alloys.

Panels 106 may be affixed to the rectangular box 110 by inserting the panels within open portions of one or more u-shaped channel pieces 104 that are attached to horizontal rods. These panels 106 may be walls, floors, ceilings, or a roof. The open portions of the u-shaped channel pieces 104 secure movement of the panel 106. Additional rectangular boxes, such as rectangular box 112 and rectangular box 114 may be affixed to the rectangular box 110.

Rectangular boxes may be continually affixed to one another to create a frame for a structure. The structure may be a habitable building such as a house, apartment, accessory dwelling unit (ADU), or the like. Alternatively, the structure may be a commercial or industrial building. Rectangular boxes that are coupled together to form a structure may comprise different shapes and building materials. For instance, the sides of the rectangular boxes in a structure may include various panels or no panels. For example, an interior of a structure may omit various panels to make space for inhabitants inside. Likewise, the panels 106 on the outside of a structure may be different from the panels 106 on the inside of a structure. The sides of the rectangular boxes that ultimately make up the structure may comprise various lengths. The lengths of the rods 102 for the various rectangular boxes may vary for different rectangular boxes.

In various embodiments, the panels 106 of corrugated steel may comprise insulation 116 that is placed within the folds of the corrugated steel. The resulting side is both strong and provides insulation.

Figure 2:
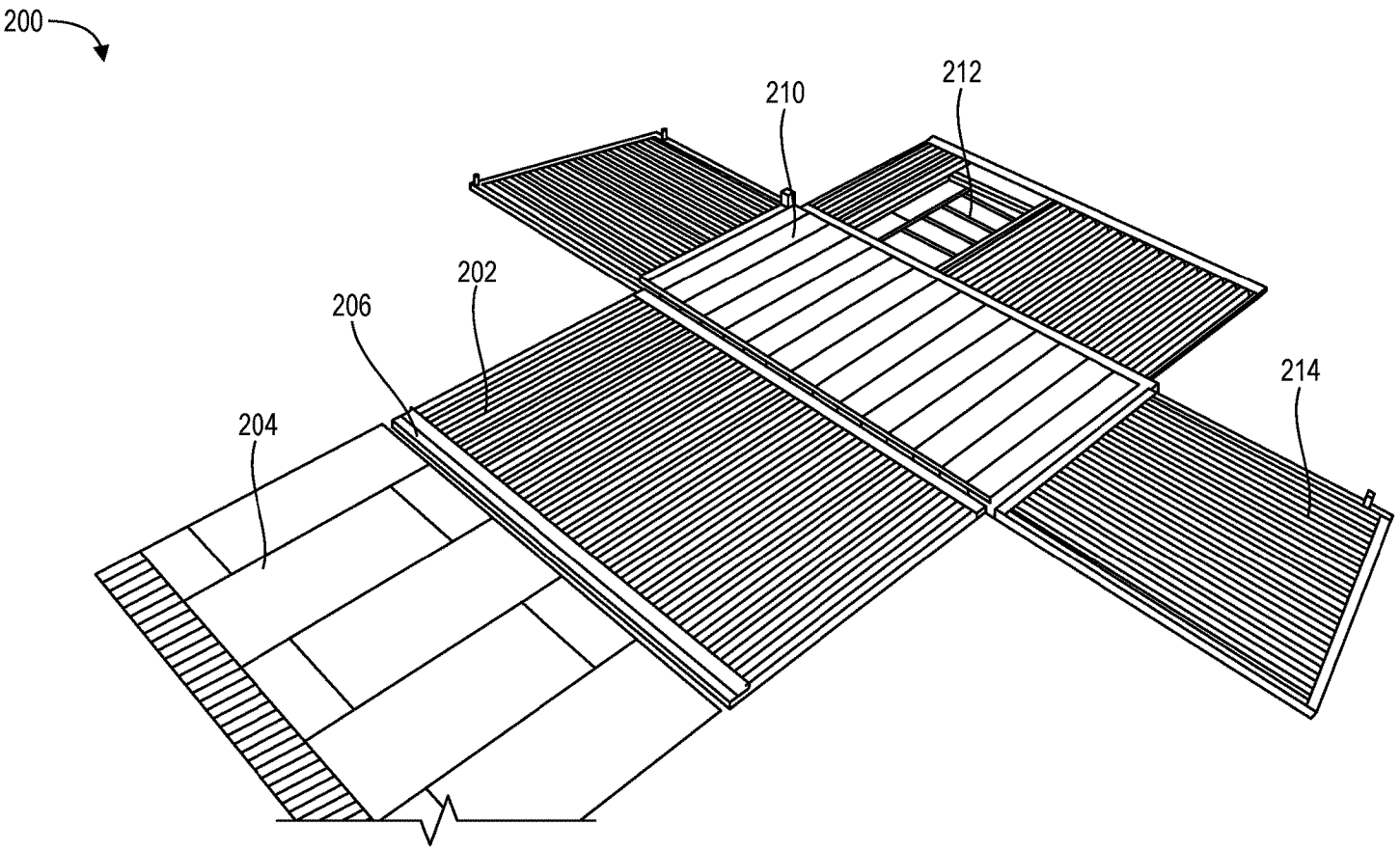
FIG. 2 is an illustration of an embodiment of the disclosed subject matter in a flat state before assembly.

Referring to FIG. 2, FIG. 2 is an illustration 200 of an embodiment of the disclosed subject matter in a flat state before assembly. The rods and panels that make up the rectangular box of the disclosed subject matter may be partially assembled off-site at a manufacturing facility and completed on-site at a building location.

In various embodiments, the rods 102 and panels 106 may be assembled into separate sides without completing the structure into the rectangular box. Therefore, the incomplete sides may be easily flat packed and shipped to the building site to be completed. Like the illustration 100 shown in FIG. 1, one or more of the rods 102 may be welded to u-shaped channel pieces 206. Panel pieces 202 may be inserted into the open portions of the u-shaped channel pieces 206.

As discussed above, the panel pieces 202 that, after assembly of the rectangular box, comprise the sides of the rectangular box, may be made of different materials and have different sizes. For example, the panel 204 is covered with insulation while panel 214 does not have insulation. The panel 208 has a cutout in which a door 212 is affixed. Additional building features not shown in the illustration 200 may be inserted into cutouts in the sides. For example, windows or side rails may be placed in a side to take the place of the panels. In another example, panel 210 is a floor portion that includes C-channels for structural support and insulation, and a subflooring material such as cement board, OSB panels, or other like subflooring material. Finish-flooring material such as hardwood, vinyl, laminate flooring, tiles, cement, or the like may be added. In various embodiments, the floor portion may cover insulation that is inserted into the folds of corrugated metal.

A multitude of rectangular boxes may be assembled from the disassembled state at a building site. Alternatively, individual rectangular boxes may be completely assembled at a manufacturing site, but not fastened to one another. The individual rectangular boxes may be transported to a building site to be fastened to one another to form a habitable structure. Various embodiments may include a secondary manufacturing site that is closer to the building site than a first manufacturing site. The flat packed materials shown in FIG. 2 may be transported to the secondary manufacturing site where they are assembled into individual rectangular boxes. The individual rectangular boxes are then transported to the building site to be fastened to the other rectangular boxes to form a habitable structure.

Figure 3A:
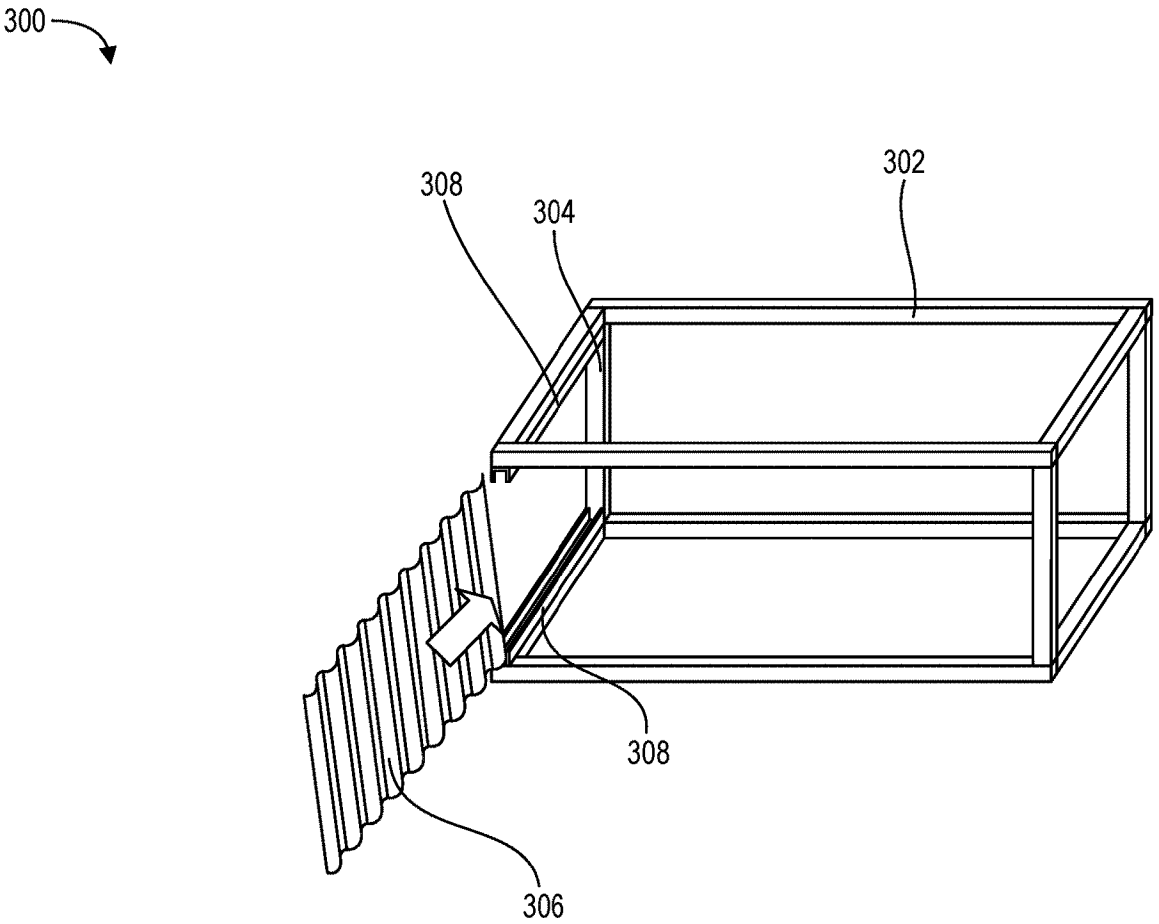
FIG. 3A is an illustration of assembled components of a rectangular box frame as a panel is inserted into a side of the rectangular box frame.

Referring to FIG. 3A, FIG. 3A is an illustration 300 of assembled components of a rectangular box frame as a panel is inserted into a side of the rectangular box frame. As shown in FIG. 1, the rectangular box frame may comprise rods 302 that are assembled into the rectangular box frame. In various embodiments, the rods that are oriented along a height axis of the rectangular box frame may comprise posts 304 that are thicker than the other rods 302.

The posts 304 may include connection pieces, which are not shown in the illustration 300, that fasten the rods 302 to the posts 304. As discussed above, one or more of the rods 302 may comprise u-shaped channel pieces 308 that are welded to the sides of the rods 302. The u-shaped channel pieces 308 may be shaped as lengths of metal that are bound together at right-angles to form three sides of a square. The open portion of the u-shaped channel pieces 308 may be used to construct and bind building materials to the rectangular box frame.

For instance, panels 306 may be inserted into open portions of the u-shaped channel pieces 308. The panels may form a side or a portion of a side of the rectangular box. As shown in FIG. 2, spaces for doors may be cut out of the panels 306. Additionally, spaces for windows or other building features may be cut out of the panels 306. In an exemplary embodiment, the panels 306 may comprise a corrugated metal such as corrugated steel. The corrugated metal is a sheet of metal that is folded in a regular pattern to increase the resistance of the metal sheet from bending in a direction that is perpendicular to the folds. Corrugated metal is available commercially from many suppliers. The corrugated metal may be inserted into the open portion of the u-shaped channel piece 308 to couple the corrugated metal to the rectangular box frame.

Figure 3B:
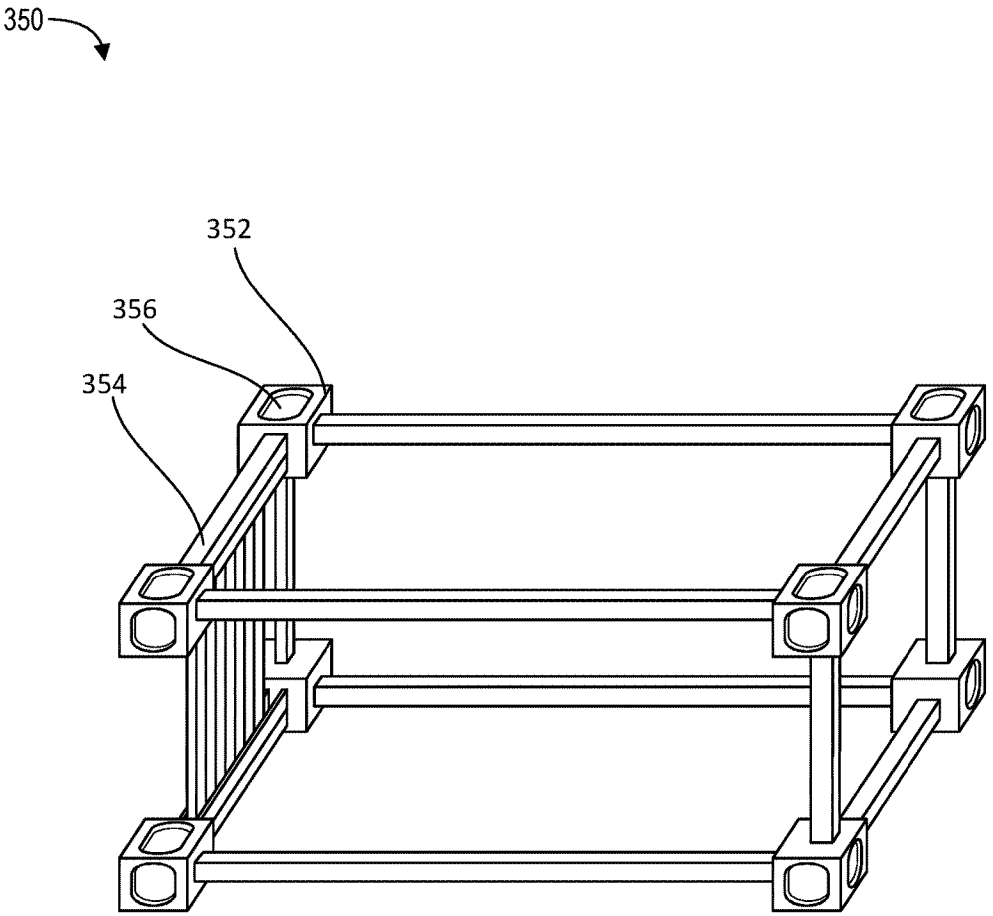
FIG. 3B is an illustration of a rectangular box frame with corner castings.

Referring to FIG. 3B, FIG. 3B is an illustration of a rectangular box frame 350 with corner castings. The corner castings are female connectors that accept the rods 354 in the rectangular box frame 350. The rods 354 in the rectangular box frame 350 may be connected to a corner casting 352 at both ends of the rod 354. The corner castings 352 may thus comprise the corners of the rectangular box frame 354.

In various embodiments, the corner castings 352 of two adjacent rectangular box frames may be connected via twist locks. By using corner castings 352 and twist locks, multiple rectangular box frames 350 may be joined relatively easily with a minimum of parts. In various embodiments, a habitable structure includes two or more rectangular box frames with corner castings 352 that are fastened to one another by twist locks.

In an exemplary embodiment, the corner castings 352 may be custom built to fit in the rectangular box frame 350. Accordingly, the openings 356 in the corner casting 352 may be sized to fit the rods 354 of the rectangular box frame 350. The rods 354 may then be easily welded to the corner castings 352. Further, twist locks, which are not shown in FIG. 3B, may be sized for the corner casting 352.

Figure 4A:
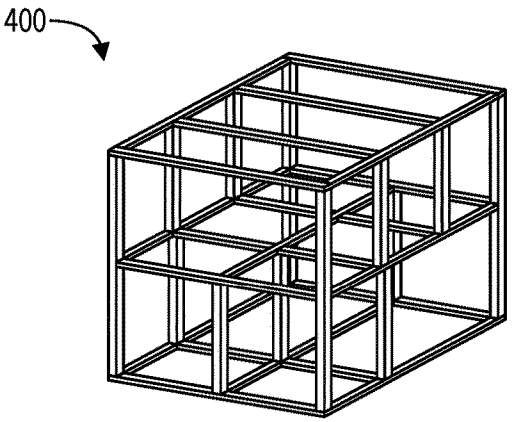
FIG. 4A is an illustration of a multitude of rectangular box frames that are coupled to each other.

Referring to FIG. 4A, FIG. 4A is an illustration 400 of a multitude of rectangular box frames that are fastened to each other. The illustration 400 shows three rectangular box frames stacked on top of two rectangular box frames. The three rectangular box frames on top are shorter in length than the two rectangular box frames on the bottom. Further, the rectangular box frames on the top are arranged perpendicularly to the rectangular box frames on the bottom. The various rectangular box frames on the top and bottom may be fastened to one another where their edges align with the other rectangular box frames.

Figure 4B:
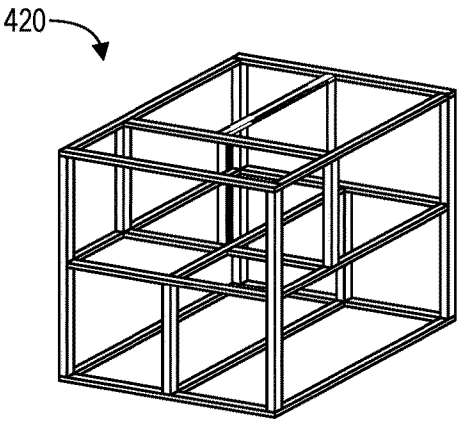
FIG. 4B is another illustration of a multitude of rectangular box frames that are coupled to each other.

Referring to FIG. 4B, FIG. 4B is an illustration 420 of a multitude of rectangular box frames that are fastened to each other. Like the illustration 400 in FIG. 4A, the illustration 420 shows three rectangular box frames stacked on top of two rectangular box frames. The two rectangular box frames on the bottom are longer than the rectangular box frames on the top. Unlike the illustration 400 in FIG. 4A, two of the rectangular box frames on the top are oriented in parallel with the rectangular box frames on the bottom. One of the rectangular box frames on the top is oriented perpendicularly to the other rectangular box frames in the illustration 420.

Figure 4C:
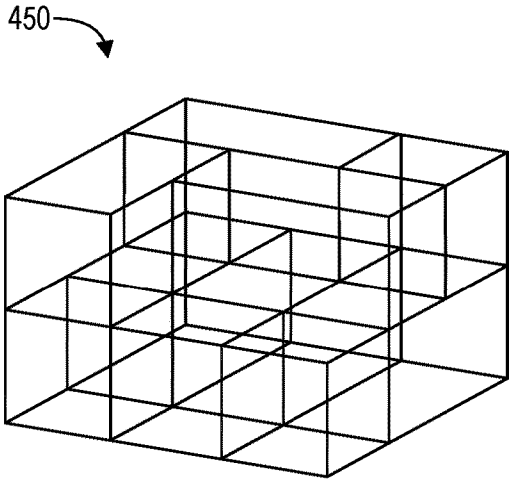
FIG. 4C is another illustration of a multitude of rectangular box frames that are coupled to each other.

Referring to FIG. 4C, FIG. 4C is another illustration 450 of a multitude of rectangular box frames that are fastened to each other. In the illustration 450, there are three rectangular box frames on the bottom, all of which are oriented in the same direction. There are three rectangular box frames stacked on a top layer. The rectangular box frame on the top and back is the same length as the rectangular box frames on the bottom and is oriented perpendicular to the rectangular box frames on the bottom. The two other rectangular box frames on the top layer have a shorter length than the other rectangular box frames on the bottom layer an on the top-back. One of the short rectangular box frames on the left side is oriented perpendicular to the rectangular box frames on the bottom layer while the rectangular box frame on the right is oriented perpendicular to the rectangular box frames on the bottom layer.

Figure 4D:
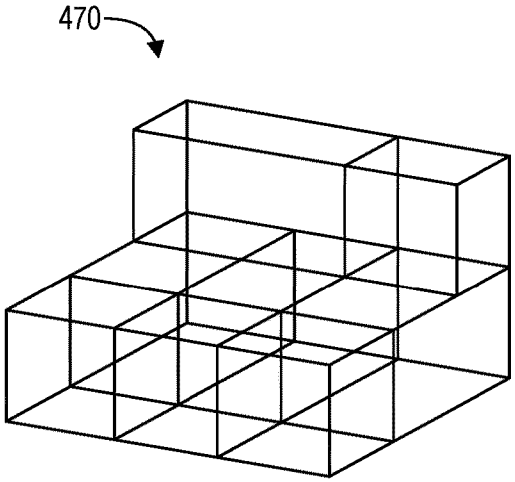
FIG. 4D is another illustration of a multitude of rectangular box frames that are coupled to each other.

Referring to FIG. 4D, FIG. 4D is another illustration 470 of a multitude of rectangular box frames that are fastened to each other. The illustration 470 shows a total of four rectangular box frames that are fastened to form a structure. The structure has a large lower level comprising three rectangular box frames that are oriented in the same direction. The upper level of the structure has only one rectangular box frame, which is oriented perpendicular to the rectangular box frames on the lower level. Each of the four rectangular box frames in the illustration has the same dimensions.

The various configurations of rectangular box frames coupled together in FIGS. 4A-4D shows potential frames for structures that may be built with the disclosed subject matter. The various configurations can be further expanded horizontally and vertically with many more units. Accordingly, many more configurations are possible including, but not limited to combining one or more of the structures shown in FIGS. 4A-4D, building a structure with more than two levels of rectangular box frames, orienting the rectangular box frames in additional directions, and using additional rectangular box frames with dimensions that are bigger or smaller than the two types of rectangular box frames in the illustrations shown in FIGS. 4A-4D.

Figure 5A:
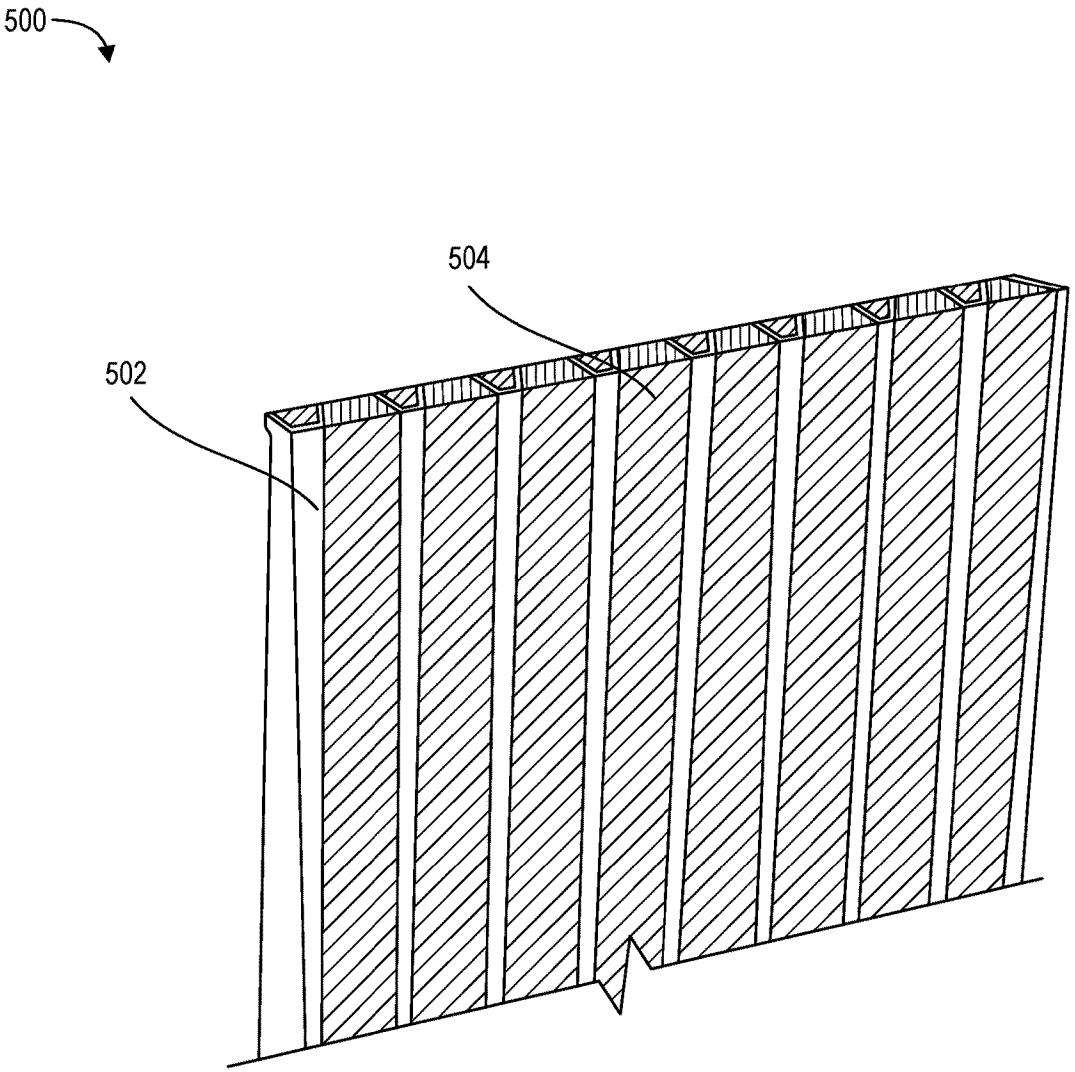
FIG. 5A is an illustration of a panel comprising corrugated steel and insulation.

Referring to FIG. 5A, FIG. 5A is an illustration of a panel 500 comprising corrugated metal 502 and insulation 504. As mentioned above, corrugated metal may be used as a panel for one or more sides of the rectangular boxes that are made from a multitude of rods. The corrugated metal is widely produced and is a relatively cheap material. Further, the regular folds in the corrugated metal provide rigidity against bending perpendicular to the folds. Thus, as folds in the panel 500 are vertically oriented, the folds provide rigidity against horizontal bending of the panel 500.

The corrugated metal may be produced from a variety of metal types including, but not limited to steel, mild steel, stainless steel, aluminum, copper, and brass. The folds in the corrugated metal effectively give the metal a greater width than the sheet metal. The space in between folds is empty. As shown in FIG. 5A, insulation is inserted into the empty space between the folds in the corrugated metal. Thus, the use of insulation 504 makes use of the space taken up by the corrugated metal in the rectangular box frame. The insulation 504 may be inserted into folds on the front and back of the corrugated metal, as shown in FIG. 5. Alternatively, the insulation 504 may be used on just one side or a portion of one or both sides of the corrugated metal.

Further, various types of insulation 504 may be layered onto the corrugated metal to enhance the insulation. In an exemplary embodiment, a first layer comprising a thermal insulation material is inserted into the folds of the corrugated metal and a second layer comprising sound insulation material is inserted on top of the first layer. Any number of panels in a structure of the disclosed subject matter may comprise insulated corrugated metal, as shown in FIG. 5A.

Figure 5B:
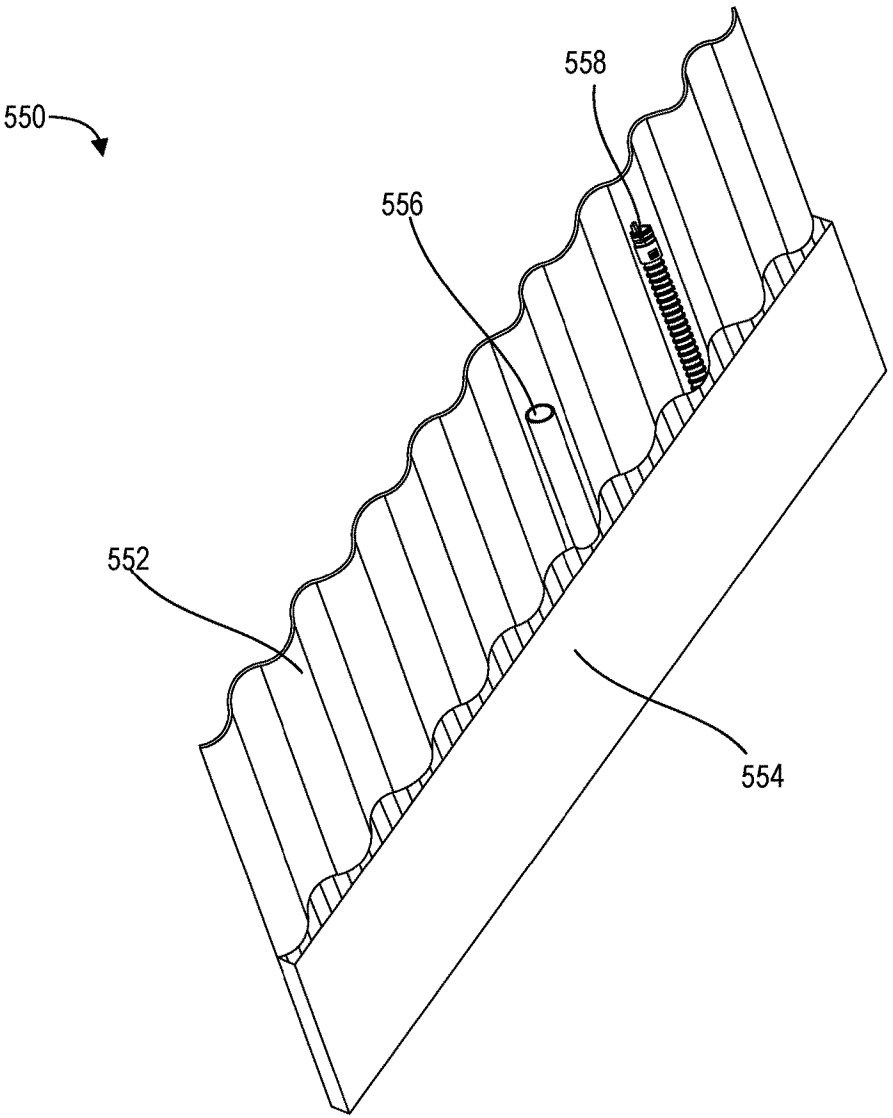
FIG. 5B is an illustration of a panel comprising corrugated metal, plumbing, electrical wires, and insulation that partially covers the corrugated metal.

Referring to FIG. 5B, FIG. 5B is an illustration of a panel 550 comprising corrugated metal 552, plumbing 556, electrical conduit 558, and insulation 554 that partially covers the corrugated metal 552. Various structure components may be inserted into folds in the corrugated metal 552, which maximizes space. The insulation 554 in FIG. 5B only partially covers a side of the corrugated metal 552 to show an embodiment with plumbing 556 and electrical conduit 558 installed in the folds of the corrugated metal 552.

As shown in FIG. 5B, insulation may cover components that are inserted into folds of the corrugated metal 552. Additional components may include, but are not limited to internet wires, air ducts, and water drains. In an exemplary embodiment, the panel 550 may be assembled with the various components before the panel 550 is connected to the rectangular box frame. Alternatively, the various components, such as pipes that connect to a plumbing system, may be fixed to the panel 550 after the panel is connected to the rectangular box frame.

Figure 6:
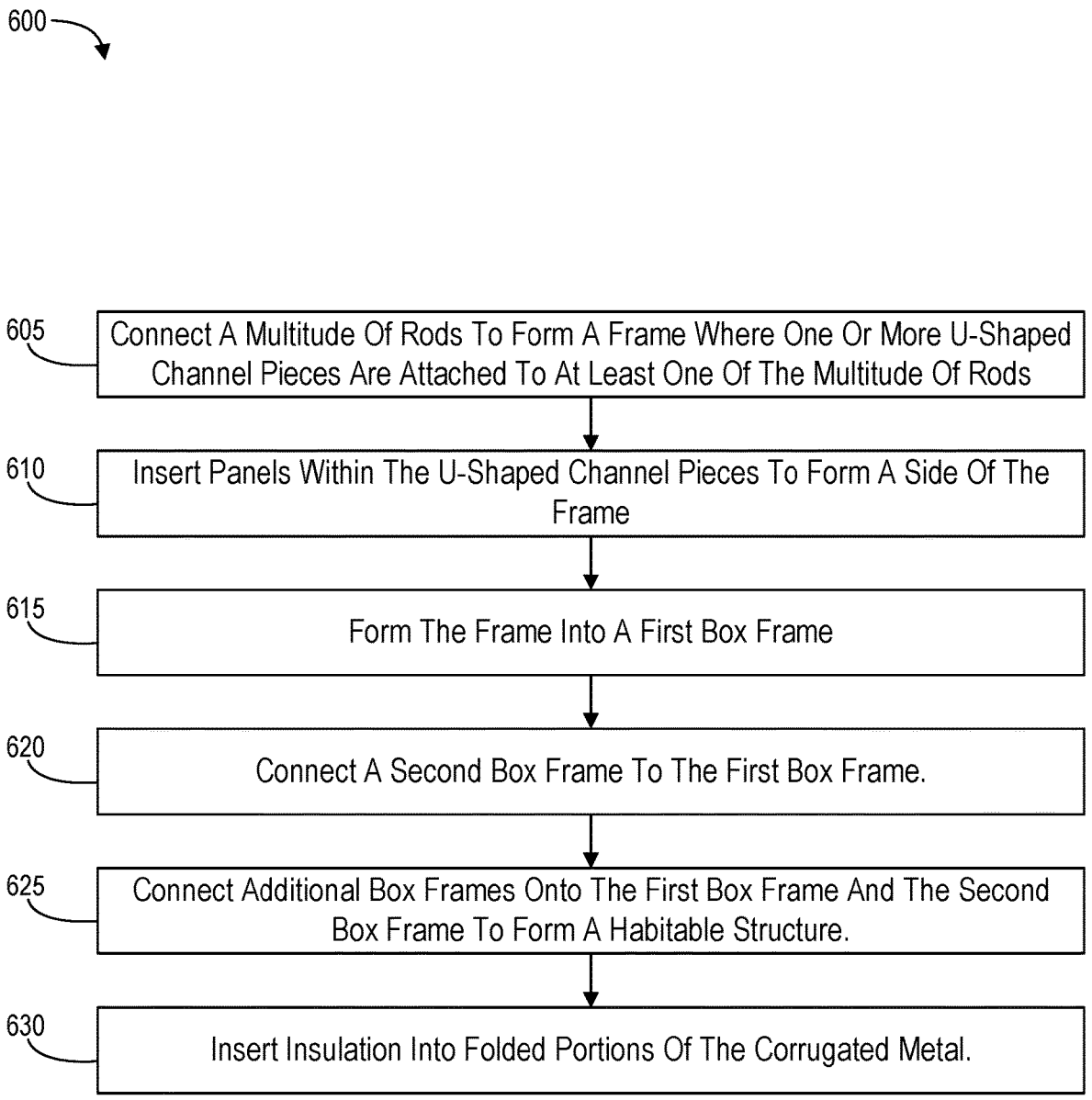
FIG. 6 is a flow diagram of a process for implementing an embodiment of the disclosed modular building.

Referring to FIG. 6, FIG. 6 is a flow diagram of a process 600 for implementing an embodiment of the disclosed modular building. The process 600 may be used to build modular buildings of various sizes. The modular buildings may be habitable structures such as a house, duplex, or apartment building. At step 605, the process may connect a multitude of rods to form a frame where one or more u-shaped channel pieces are attached to at least one of the multitude of rods. In an exemplary embodiment, a u-shaped channel piece is welded, or otherwise fixed, to a side of each of the multitude of rods. Two u-shaped channel pieces may be welded to parallel rods and positioned such that the open portions of the u-shaped channel pieces face one another. The multitude of rods may comprise a variety of materials. As discussed above, the materials may comprise metals. Additionally, the materials may comprise non-metal materials including, but not limited to wood, polymer materials, or composites of various materials. In various embodiments, all of the rods are attached to u-shaped channel pieces. In an exemplary embodiment, multiple rods are used to reinforce one another in the frame Rods may connect at right angles to form a rectangular frame. The rectangular frame may connect to additional rods to form additional rectangular frame portions. The rectangular frames may make a side in a structure. Multiple sides may be connected to form a wall, floor, ceiling, roof, or the like.

At step 610, the process 600 may insert panels within the u-shaped channel pieces to form a side of the frame. The open portion of the u-shaped channel pieces may act to secure the panel to the frame, which comprises the multitude of rods. In various embodiments, the panel may be secured on more than one side by the u-shaped channel pieces. For example, the panel may be secured by u-shaped channel pieces that form opposite sides of a rectangular frame. The panel, secured by the two opposite u-shaped channel pieces, may slide into place along the axis of the u-shaped channel pieces. As shown above, the panels may comprise corrugated metal, which is folded in a regular pattern and resists bending perpendicular to the folds.

At step 615, the process 600 may form the frame into a first box frame. In various embodiments, the frame is formed into a rectangular box before panels are inserted, as shown in FIG. 3A. Alternatively, panels may be inserted into rectangular frames before the rectangular frames are formed into a rectangular box. An example of panels in a frame before their assembly into a rectangular box is shown in FIG. 2. The resulting rectangular box, which is formed from the frame of rods, may have various heights, widths, and lengths, depending on the lengths of the multitude of rods in the rectangular box.

Further, the rectangular box, may omit one or more sides of the rectangular box. For instance, panels may cover four sides of the rectangular box, leaving 2 sides open. In various embodiments, panels on a bottom side of the rectangular box form a floor side and one or more panels on the sides adjacent to the floor side form wall sides. The panel opposite the floor side may form a ceiling side or a roof side. Like the panels, one or more edges may be omitted from the rectangular box. For example, the rectangular box, which comprises twelve edges for a complete rectangular box, may omit one or more edges to make space for various reasons.

At step 620, the process 600 may connect a second box frame to the first box frame. The second box frame may comprise the same or different dimensions as the first box frame. Likewise, the two box frames may have different panels, no panels, or omitted edges. The connected box frames may be adjacent and may form structural elements created by the panels in the box frames. For instance, the two adjacent box frames may form portions of continuous floors, walls, ceilings, or roof portions of a structure. The two adjacent box frames may also form adjacent levels of a structure. The first box frame may form a portion of a first level and the second box frame may form a portion of a second level.

At step 625, the process 600 may connect additional box frames onto the first box frame and the second box frame to form a habitable structure. Additional box frames may be added to the first box frame and second box frame based on the dimensions of the structure. Examples of the structures that are constructed from connecting multiple box frames are shown in FIGS. 4A-4D. The habitable structure may comprise any number of connected box frames that are stacked to various levels.

At step 630, the process 600 may insert insulation into corrugated portions of the panel. By inserting insulation into the regular folds of the corrugated metal, the spaces in the corrugated metal are well utilized. The efficient use of space allows for additional room inside that structure. The insulation may be inserted into one or both sides of the corrugated metal. In various embodiments, the insulation may be inserted into only a portion of the corrugated metal that comprises a panel.

In an exemplary embodiment, insulation is installed by spraying an insulating material onto the corrugated metal. The spray-on insulation may be installed onto the corrugated metal before the corrugated metal is inserted into the u-shaped channel pieces. Further, the insulation may cover additional components on the corrugated metal such as plumbing, vent lines, or electrical conduit.

Figure 7:
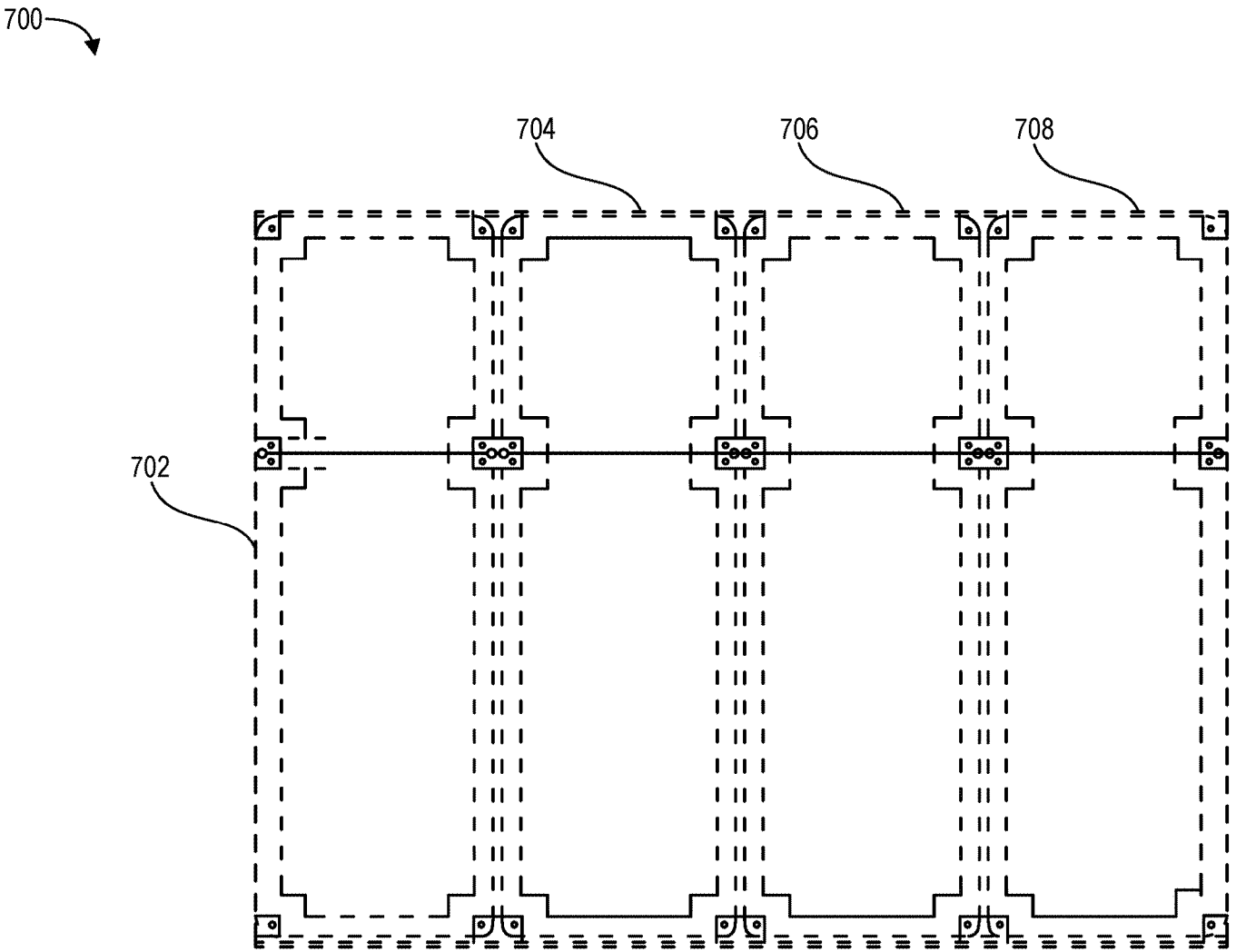
FIG. 7 is an illustration of a blueprint for a modular building comprising a multitude of rectangular box frames.

Referring to FIG. 7, FIG. 7 is an illustration of a blueprint 700 for a modular building comprising a multitude of rectangular box frames. The rectangular box frames are constructed by connecting a multitude of rods, one or more of which have u-shaped channel pieces attached thereto. The rods comprise the edges of the rectangular box frames. The rectangular box frames may be aligned such that one or more portions of their edges overlap. Overlapping edges may be connected to form the structure shown in FIG. 7.

The blueprint 700 shows four rectangular box frames from a top view. The four rectangular box frames are connected to each other on one or two sides of the rectangular box frames. The connections on the sides of the rectangular box frames are made at the edges or corners of the rectangular box frames.

In the blueprint 700, the four rectangular box frames are lined up in a series starting at rectangular box frame 702, which in turn is connected to rectangular box frame 704, which in turn is connected to rectangular box frame 706, and which in turn is connected to rectangular box frame 708. The rectangular box frames may be attached to one another at adjacent edges. In various embodiments, the rectangular box frames include corner castings. Twist locks may connect two rectangular box frames via the corner castings.

Figure 8:
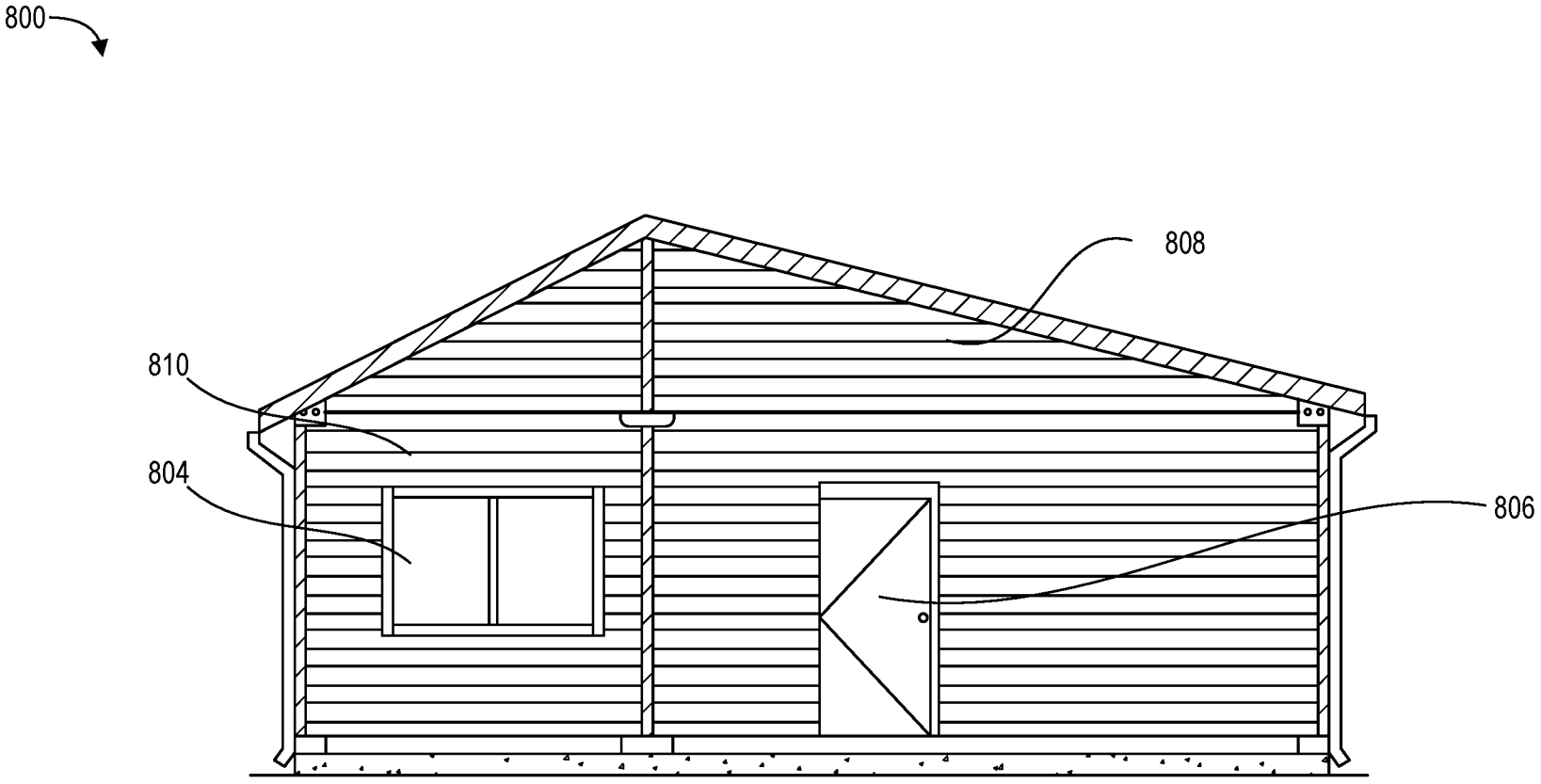
FIG. 8 is a side view of the illustration for a modular building comprising a multitude of rectangular box frames.

Referring to FIG. 8, FIG. 8 is a side view of the illustration for a modular building 800 comprising a multitude of rectangular box frames. The modular building 800 shown in FIG. 8 is a side view of a building constructed from the blueprint shown in FIG. 7. The view of the blueprint 700 of the modular building corresponds to a view from the left side of rectangular box frame 702.

Note that the side of the rectangular box has various building elements cut out of the visible side 810 in the illustration of the modular building 800. The one or more panels that make of the visible side 810 of the modular building may be precut before inserting the one or more panels into the rectangular box frame that makes up the visible side 810 of the modular building 800. Thus, the window 804 and door 806 may be constructed and installed in a manufacturing facility that is off-site, which may allow for greater resources to be utilized in installing them.

Even where the window 804 and/or door 806 are installed on-site, the cutout portions of the visible side 810 of the modular building 800 may be precut, saving the time of installing a frame for the window 804 and door 806 elements. In addition to the window 804 and door 806 elements, the visible side 810 of the modular building 800 shows a roof section 808. In various embodiments, the roof section 808 may comprise a triangular prism frame that rests on top of a rectangular box frame.

Figure 9A:
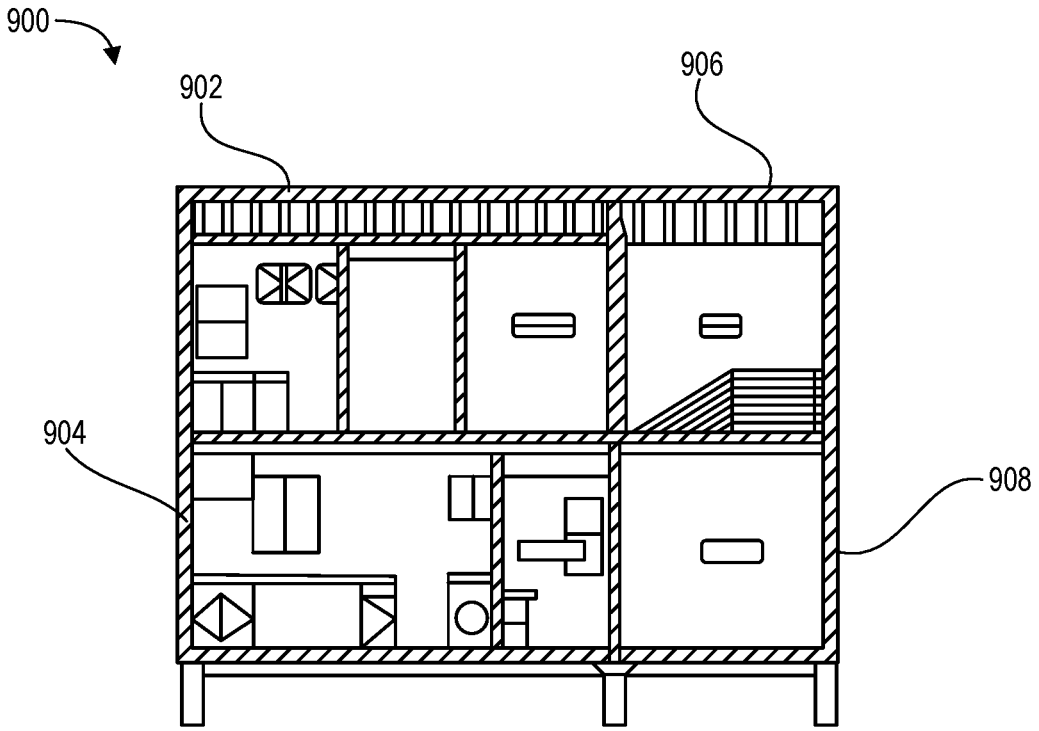
FIG. 9A is a side view of an illustration of a blueprint for a modular building comprising a multitude of rectangular box frames.

Referring to FIG. 9A, FIG. 9A is a side view of an illustration of a blueprint 900 for a modular building comprising a multitude of rectangular box frames. The blueprint 900 shows a habitable structure that comprises two levels of stacked rectangular boxes. The top level comprises rectangular box 902 and rectangular box 906. Rectangular box 902 is oriented with its length going from left to right in the blueprint 900. The length of rectangular box 906 is oriented perpendicular to rectangular box 902.

Similarly, the bottom level comprises rectangular box 904, which is oriented with its length going from left to right in the blueprint 900. The bottom level also comprises rectangular box 908, which is oriented perpendicular to rectangular box 904 and is under rectangular box 906. The interior portions of the blueprint 900 show various elements such as bathroom, kitchen, and living space.

Figure 9B:
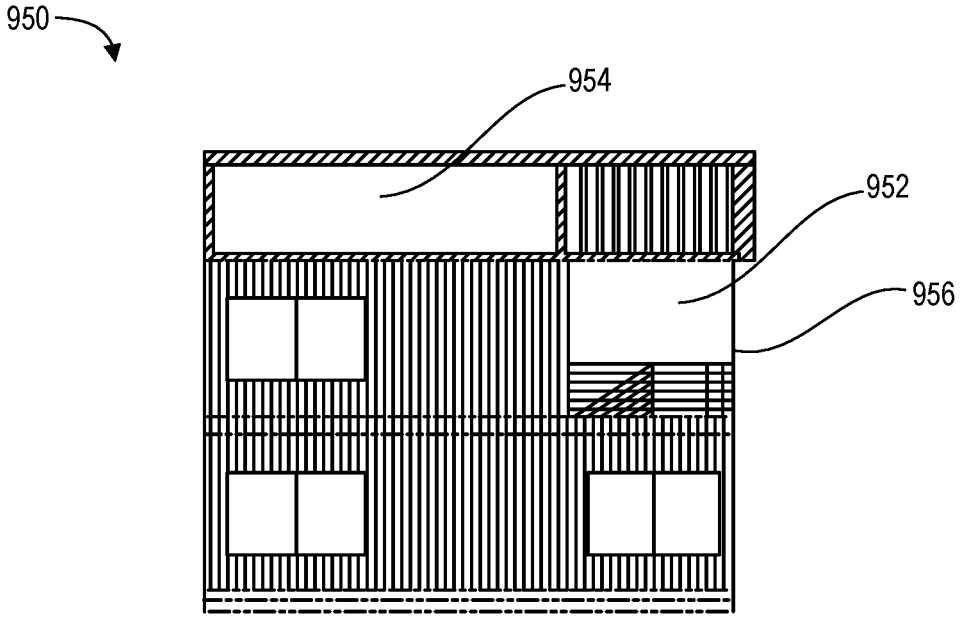
FIG. 9B is a side view of an illustration of a modular building comprising a multitude of rectangular box frames.

Referring to FIG. 9B, FIG. 9B is a side view of an illustration of a modular building 950 comprising a multitude of rectangular box frames. The modular building 950 shows an outside view of the blueprint 900 shown in FIG. 9A. Like the modular building 800 shown in FIG. 8, the modular building 950 has multiple cutouts in the visible side for various building features. There are three cut out portions of the wall that have windows installed in them. The windows may be installed in panels at an off-site facility before the panels are inserted into the modular building 950.

Note that the upper level of the modular building 950 has an open portion on the right side. The open portion may be constructed by omitting one or more side panels on rectangular box 906. Also note that even though one or more side panels are omitted from the open portion 952, the rectangular box frame that makes up the open portion still has a rod 956 without panels attached.

Also, like the modular building 800, the modular building 950 shown in FIG. 9B has a roof portion 954. The roof portion 954 is affixed to the various rectangular box frames and panels on the top level of the modular building 950.

Figure 10:
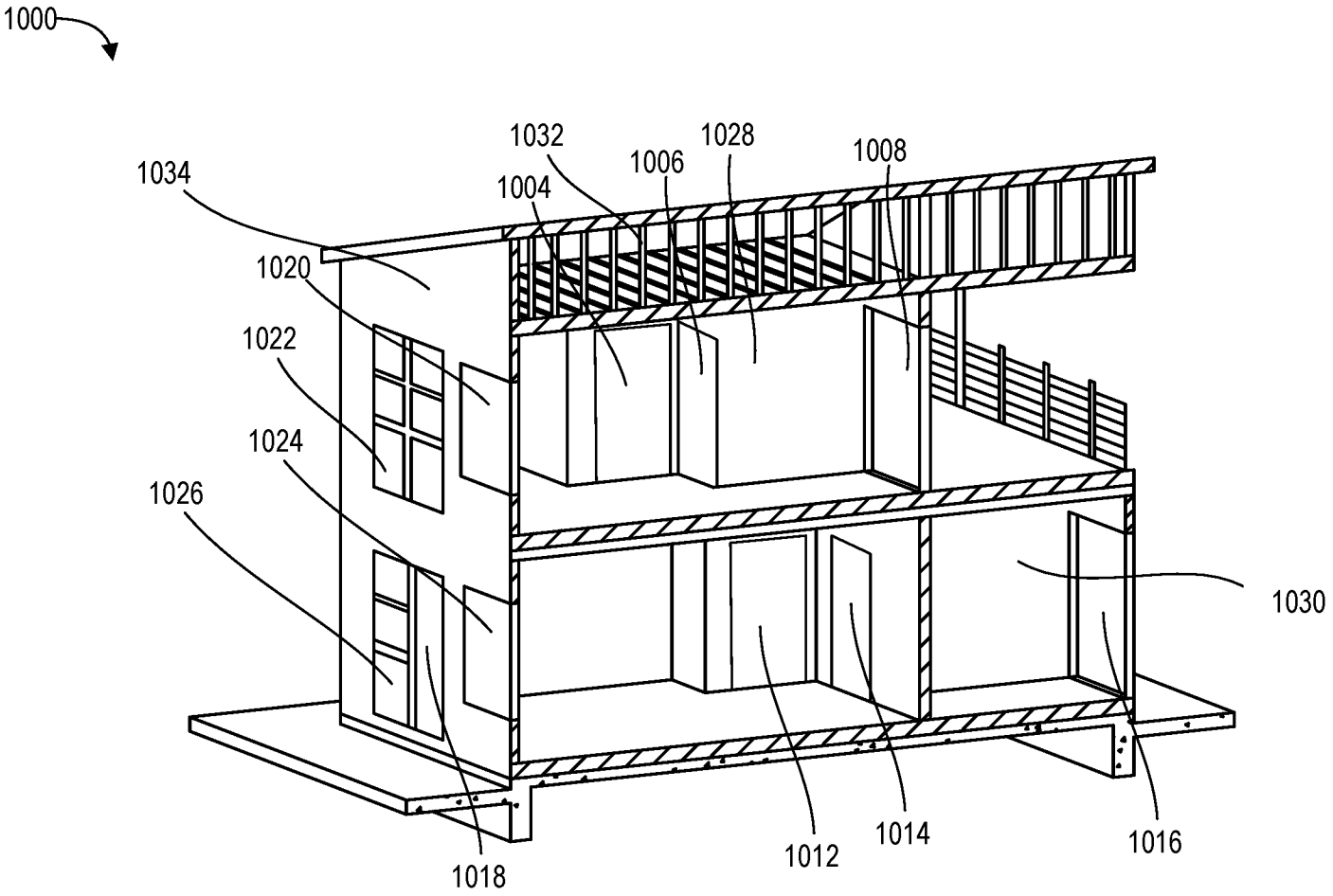
FIG. 10 is a perspective view of a cross-section of a modular building comprising a multitude of rectangular box frames.

Referring to FIG. 10, FIG. 10 is a perspective view of a cross-section of a modular building 1000 comprising a multitude of rectangular box frames. The cross-section shows additional doors and windows that may be constructed off-site at a manufacturing facility before being transported to a building site of the modular building 1000. On the top level, door 1004, door 1006, and door 1008 may be inserted into cut away portions of panels. The doors may be inserted into the panels before the panels are inserted into a rectangular box frame of the modular building 1000. Thus, additional resources may be spent on installation of the doors that could not otherwise be accomplished on a door that is installed on-site. Likewise, door 1012, door 1014, door 1016, and door 1018 may be inserted into cut away portions of the panels on the bottom level.

Like the doors, window 1020, window 1022, window 1024, and window 1026 may be installed into cut out portions of panels on the left side of the modular building 1000 shown in FIG. 10. The windows may be installed or partially installed at a manufacturing facility before the panels are transported to a building site to assemble them into the modular building 1000. A partial installation of windows may comprise installing a frame without glass for windows, which may allow for the panel to be transported without risk of breaking the glass.

In addition to window and door building elements, interior walls may be installed in the modular building 1000. Interior wall 1028 and interior wall 1030 are whitewall material. In various embodiments, the whitewall material may cover panels of the rectangular box frames of the modular building 1000. The whitewalls may cover corrugated metal that has insulation inserted into its folds, as shown in FIG. 5.

The roof 1032 portion of the modular building 1000 may be placed on top of the rectangular boxes on the upper level. A side 1034 of the roof portion may be integrated with the lower walls on the side of the modular building 1000, which creates one seamless wall. The various wall, floor, and ceiling portions of the modular building 1000 may comprise corrugated metal that has insulation inserted into its folds.

Figure 11:
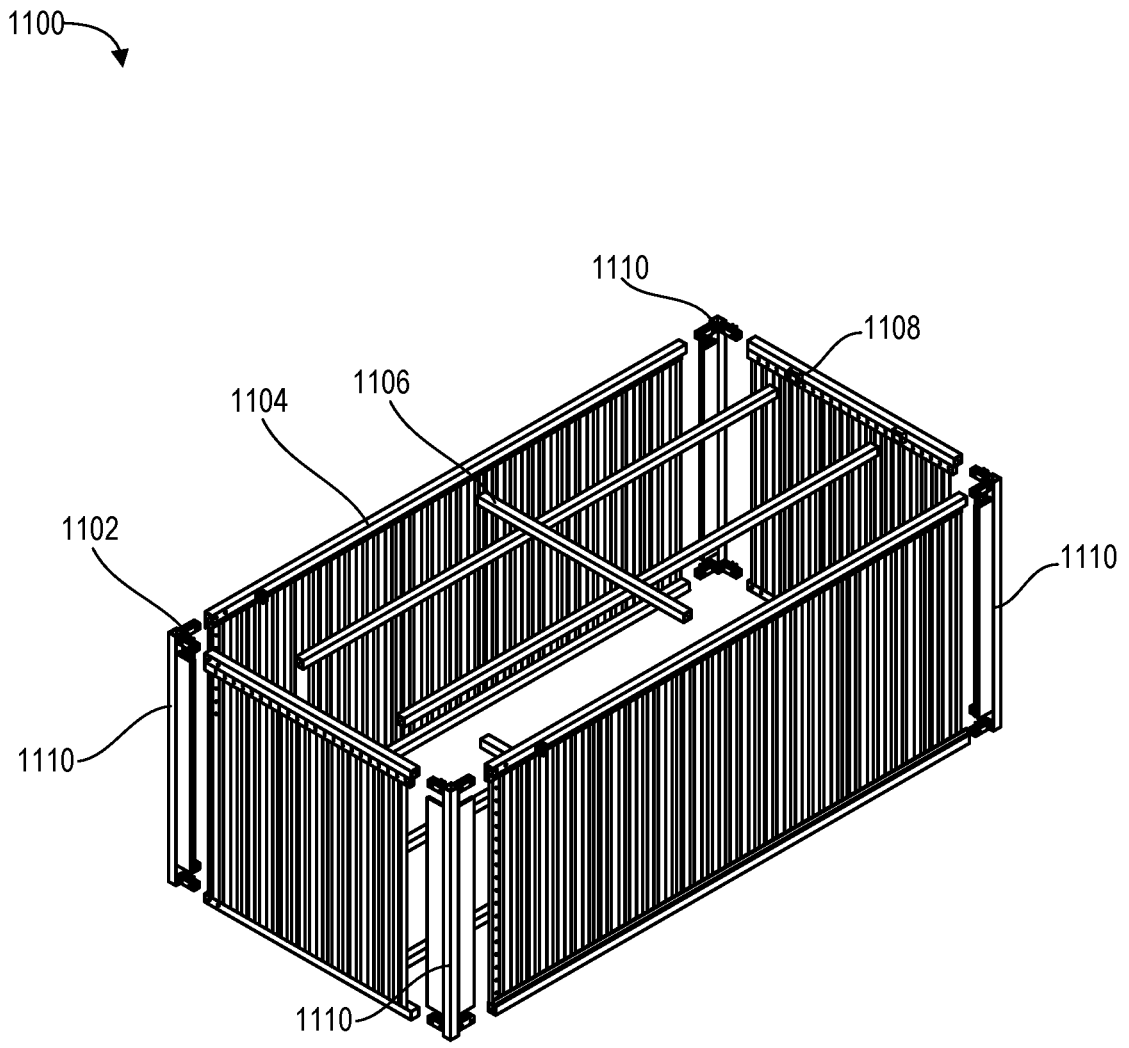
FIG. 11 is an illustration of an embodiment of the disclosed subject matter.

Referring to FIG. 11, FIG. 11 is an exploded view 1100 of an embodiment of the disclosed subject matter. The illustration shows a variation of the rectangular box. Elements of the rectangular box that are different from the rectangular box shown in FIG. 1 include but are not limited to corner pieces 1102 and a multitude of side rods 1106 that extend across a side of the rectangular box in addition to the edge rods 1104 that extend across the edges of the rectangular box.

The corner pieces shown in FIG. 11 may comprise a corner rod 1110 with four prongs. The corner rod 1110 has two prongs on each end of the corner rod 1110. The two prongs on each end of the corner rod 1110 are orthogonal to each other and to the corner rod 1110 such that the two prongs on each end and the corner rod 1110 make right angles with one another. The rectangular box frame may comprise four corner pieces that connect rods that make up twelve edges of the rectangular box frame.

Alternatively, the rectangular box frame may comprise eight corner pieces 1102 that comprise three prongs whereby each of the three prongs connect to a rod that makes an edge of the rectangular box frame. The three prongs of the corner pieces are oriented orthogonally to one another such that the rods that connect to all three prongs may make right angles with one another. The three prongs of the corner pieces may be configured to connect to rods of different sizes. For instance, a corner piece may have one prong that is configured to connect to a rod of larger width than the two other prongs of the corner piece. In one example, the rods that are oriented to traverse a width of the rectangular box frame may be thicker than the other rods. In FIG. 11, the rods that traverse the width of the rectangular box frame may be the four vertically oriented rods.

The rectangular box frame shown in FIG. 11 includes side rods 1106 that connect to edge rods 1104. The edge rods 1104 comprise the twelve edges of the rectangular box frame. Each of the edge rods 1104 are connected to a corner piece 1102. The side rods 1106 do not comprise the edges of the rectangular box frame and do not connect to the corner pieces. Instead, the side rods 1106 connect to the edge rods 1104 via connector pieces 1108. Thus, the side rods 1106 traverse a side of the rectangular box frame. The side rods 1106 shown in FIG. 11 traverse a top side of the rectangular box frame.

Figure 12:
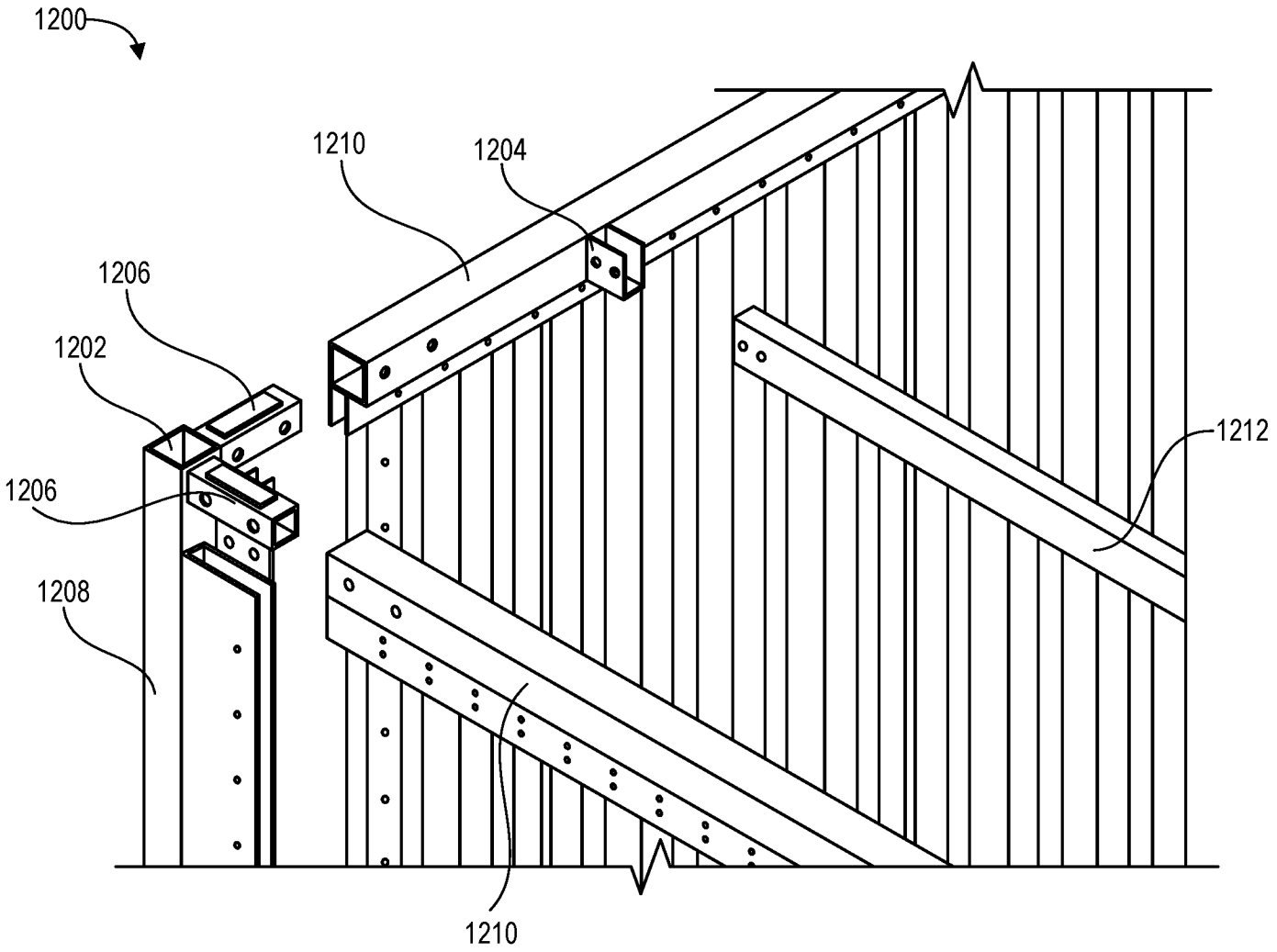
FIG. 12 is an illustration of a magnified view of an embodiment of the disclosed subject matter.

Referring to FIG. 12, FIG. 12 is an illustration 1200 of a magnified view of an embodiment of the disclosed subject matter. The illustration 1200 shows a close-up view of the corner rod 1202. The corner rod 1202 comprises a metal beam 1208 with two orthogonally oriented prongs 1206 on both ends of the corner rod.

The illustration 1200 shows two of the four prongs that are attached to the corner rod 1202. The metal beam 1208 is thicker than the two orthogonally oriented prongs 1206 attached to the metal beam 1208. The edge rods 1210 that connect to the orthogonally oriented prongs 1206 are beams that are thicker than the prongs and may be inserted over the prongs to connect the edge rods 1210 to the corner rod 1202.

The illustration 1200 shows a rod connector 1204 that is attached to a midpoint of the edge rod 1210 in between the two ends of the edge rod. The rod connector 1204 allows a side rod 1212 to connect to the midpoint of the edge rod 1210. As mention above, the side rod 1212 traverses a side of the rectangular box frame instead of an edge. In various embodiments, a u-shaped channel piece is attached to the side rod 1212. One or more panels may be inserted into the u-shaped channel piece that is attached to the side rod 1212, which allows for the installation of panels inside the rectangular box frame. Installation of panels inside the rectangular box frame may allow for walls, floors, ceilings, roofs, and the like to be installed with more versatility than where they are constricted to the sides of the rectangular box.

Many variations may be made to the embodiments described herein. All variations are intended to be included within the scope of this disclosure. The description of the embodiments herein can be practiced in many ways. Any terminology used herein should not be construed as restricting the features or aspects of the disclosed subject matter. The scope should instead be construed in accordance with the appended claims.

The invention claimed is:

1. A modular building system comprising:

a plurality of rods comprising a corner rod and an edge rod, the corner rod comprising a prong, the plurality of rods configured to connect to each other to form a frame; and a panel that attaches to the frame to form a side, the panel comprising corrugated metal with folded portions, with insulation disposed into one or more empty spaces between the folded portions, wherein the insulation comprising a first layer of thermal insulation material disposed within the folded portions and a second layer of sound insulation material layered on top of the first layer.

2. The modular building system of claim 1, wherein the panel is attached to the frame by a pair of u-shaped channel pieces positioned parallel to one another with open portions facing one another.

3. The modular building system of claim 2, wherein the open portions of the u-shaped channel pieces are configured to secure movement of the panel.

4. The modular building system of claim 1, wherein the frame forms a first box frame comprising twelve edges; and wherein the twelve edges of the first box frame enclose six separate sides.

5. The modular building system of claim 4, further comprising a second box frame comprising twelve edges and six sides;

wherein at least one edge of the second box frame is configured to be connected to the first box frame.

6. The Modular building system of claim 5, wherein additional box frames are connected to the first box frame and the second box frame to form a habitable structure, the habitable structure comprising:

one or more floors;

one or more windows;

one or more walls; and one or more ceilings.

7. A method for constructing a modular building, the method comprising:

connecting a plurality of rods to form a frame, the plurality of rods comprising a corner rod and an edge rod, the corner rod comprising a prong; and attaching a panel to the frame to form a side, the panel comprising corrugated metal with folded portions, with insulation disposed into one or more empty spaces between the folded portions, wherein the insulation comprising a first layer of thermal insulation material disposed within the folded portions and a second layer of sound insulation material layered on top of the first layer.

8. The method of claim 7, wherein the panel is attached to the frame by a pair of u-shaped channel pieces positioned parallel to one another with open portions facing one another.

9. The method of claim 8, wherein the open portions of the u-shaped channel pieces are configured to secure movement of the panel.

10. The method of claim 7, further comprising: forming the frame into a first box frame; and connecting a second box frame to the first box frame.

11. The method of claim 10, further comprising connecting additional box frames onto the first box frame and the second box frame to form a habitable structure, the habitable structure comprising:

one or more floors;

one or more windows;

one or more walls; and one or more ceilings.

12. The method of claim 8, wherein the insulation is sprayed onto the corrugated metal before the panel is inserted within the pair of u-shaped channel pieces.

13. The modular building system of claim 1, wherein the insulation is disposed on one side or a portion of one or both sides of the corrugated metal.

* * * * *